US005330664A

United States Patent [19]

Wollenberg et al.

[11] Patent Number: 5,330,664

[45] Date of Patent: Jul. 19, 1994

[54] NEUTRAL AND LOW OVERBASED ALKYLPHENOXY SULFONATE ADDITIVE COMPOSITIONS DERIVED FROM ALKYLPHENOLS PREPARED BY REACTING AN OLEFIN OR AN ALCOHOL WITH PHENOL IN THE PRESENCE OF AN ACIDIC ALKYLATION CATALYST

[75] Inventors: Robert H. Wollenberg, Orinda; Richard J. Nelson, Pinole; John McDonald, Emeryville; Susanne G. Ruelas, San Pablo; Curtis B. Campbell, Hercules, all of Calif.; Kathryn E. Matera, Northford, Conn.

[73] Assignee: Chevron Research and Technology Company, San Francisco, Calif.

[21] Appl. No.: 939,195

[22] Filed: Sep. 2, 1992

[51] Int. Cl.[5] ..... C10M 135/10; C10M 159/24

[52] U.S. Cl. ..... 252/18; 252/33; 562/82

[58] Field of Search ..... 252/18, 33; 562/82

[56] References Cited

U.S. PATENT DOCUMENTS

| | | | |
|---|---|---|---|
| 2,133,287 | 10/1938 | Flett | 562/82 |
| 2,205,951 | 6/1940 | Robinson | 562/82 |
| 2,213,588 | 9/1940 | Mikeska | 562/82 |
| 2,237,066 | 4/1941 | Weisberg et al. | 562/82 |
| 2,483,501 | 10/1949 | McNab et al. | 252/33 |
| 2,556,848 | 6/1951 | McNab et al. | 562/82 |
| 2,716,127 | 8/1955 | DeGroote | 252/33 |
| 2,828,334 | 3/1958 | DeGroote | 252/33 |
| 3,169,987 | 2/1965 | Bloch et al. | 260/505 |
| 3,422,161 | 1/1969 | Lavigne et al. | 252/33 |
| 3,470,097 | 9/1969 | Lavigne et al. | 252/33 |
| 3,483,262 | 12/1969 | Alul et al. | 260/624 |
| 3,487,023 | 12/1969 | Sweeney | 252/161 |
| 3,523,898 | 8/1970 | DeVault | 252/33 |
| 3,576,896 | 4/1971 | Luberoff et al. | 260/671 |
| 3,647,899 | 3/1972 | Straus | 260/668 |
| 3,666,825 | 5/1972 | Torck et al. | 260/671 R |
| 3,705,202 | 12/1972 | Massie | 260/671 C |
| 3,764,533 | 10/1973 | Hunt et al. | 252/33 |
| 3,775,325 | 11/1973 | Kerfoot et al. | 252/59 |
| 4,219,686 | 8/1980 | Petrillo et al. | 585/24 |
| 4,251,379 | 2/1981 | LeCoent et al. | 252/33 |
| 4,302,342 | 4/1981 | DeMoures et al. | 252/33.2 |
| 4,328,111 | 5/1982 | Watson et al. | 252/33.4 |
| 4,358,628 | 11/1982 | Slaugh | 585/455 |
| 4,751,010 | 6/1988 | Leone et al. | 252/33 |
| 4,929,584 | 5/1990 | Slaugh et al. | 502/112 |
| 4,933,485 | 6/1990 | Buckley | 560/159 |
| 4,950,810 | 8/1990 | Kinishi et al. | 568/790 |

FOREIGN PATENT DOCUMENTS

| | | |
|---|---|---|
| 2606105 | 6/1977 | Fed. Rep. of Germany . |
| 1332473 | 10/1973 | United Kingdom . |
| 1372532 | 11/1973 | United Kingdom . |

OTHER PUBLICATIONS

Weaver et al., "Supported Fluorocarbonsulfonic Acid Polymer Heterogeneous Acid Catalysis" in Catalysis 1987, J. W. Ward, Editor, pp. 483–489, Elsevier Science Publishers, B. V., Amsterdam, Netherlands (1988).

Baumgartner, Industrial and Engineering Chemistry, vol. 46, No. 6, pp. 1349–1352 (1954).

Korenev et al., "Effect of Alkylphenols on Colloidal Structure of Detergent–Dispersant Additives".

*Primary Examiner*—Jerry D. Johnson

*Attorney, Agent, or Firm*—Burns, Doane, Swecker & Mathis

[57] ABSTRACT

This invention is directed to neutral and low overbased alkylphenoxy sulfonates derived from alkylphenols prepared by alkylating phenol with an acidic alkylation catalyst having a Hammett ($H_o$) acidity function of about −2.3 or less (more negative).

22 Claims, No Drawings

NEUTRAL AND LOW OVERBASED ALKYLPHENOXY SULFONATE ADDITIVE COMPOSITIONS DERIVED FROM ALKYLPHENOLS PREPARED BY REACTING AN OLEFIN OR AN ALCOHOL WITH PHENOL IN THE PRESENCE OF AN ACIDIC ALKYLATION CATALYST

BACKGROUND OF THE INVENTION

1. Field of the Invention

This invention is directed to neutral and low overbased alkylphenoxy sulfonate additive compositions which, at equivalent amounts of diluent oil, have lower viscosities as compared to comparable products known in the art.

2. State of the Art

During operation, the lubricating oil employed in automobile engines accumulates sludge and other harmful deposit forming materials which, if left untreated, would greatly reduce the operating life of the engine. Typically, however, dispersant and detergent additives are added to the lubricating oil to disperse the deposit forming material so as to retard or remove deposit formations. Such additives include, by way of example, alkenyl succinimides, overbased phenates, including overbased sulfurized phenates, neutral and overbased sulfonates, including neutral and low overbased alkylphenoxy sulfonates, and the like. These additives are typically employed in a variety of combinations so that the lubricating oil formulation contains more than one dispersant or detergent to control and/or remove deposit formation.

Of particular interest are neutral and low overbased alkylphenoxy sulfonate additive compositions which are useful in providing detergency and dispersancy properties to lubricating oil compositions. Specifically, it is known that neutral and low overbased alkylphenoxy sulfonates provide for improved control of piston deposits during diesel engine operation as compared to highly overbased alkylphenoxy sulfonates. In addition, low overbased alkylphenoxy sulfonates provide a measure of alkalinity reserve, albeit small, which is useful in neutralizing acids generated during engine operation especially when engines are operating on sulfur containing fuels.

The formation of neutral and low overbased alkylphenoxy sulfonate additive compositions by alkylation of phenol, sulfonation of the alkylated phenolic compounds and subsequent neutralization of the alkylphenol sulfonic acid by at least a stoichiometric equivalent of an alkaline earth metal base are, in a very general sense, known in the art.

For example, British Patent Specification No. 1 332 473 discloses the preparation of neutral alkylphenoxy sulfonate additive compositions and further discloses conversion of these materials to overbased alkylphenoxy sulfonate additive compositions (i.e., having a TBN of about 200 or more).

Similarly, U.S. Pat. No. 4,751,010 discloses the preparation of neutral and overbased alkylphenoxy sulfonate additive compositions useful as detergent-dispersant additives in lubricating oils. The disclosed preparation involves the neutralization of an alkylphenoxy sulfonic acid, followed by sulfurizing/over-alkalinizing the salt obtained and then carbonating the resultant salt.

Similarly, French Patent No. 2,584,414 relates generally to detergent-dispersant lubricant additives prepared from alkylphenol sulfonic acid by neutralization, sulfurization, overbasing, and carbonation.

While neutral and low overbased alkylphenoxy sulfonate additive compositions are well known in the art, the preparation of these compositions has been substantially hindered by the fact that certain alkylphenoxy sulfonic acids, used as intermediates in the preparation of neutral and low overbased alkylphenoxy sulfonate additive composition, are unstable at high temperatures (e.g., >50° C.) and/or during prolonged storage/shipment and this instability can result in spontaneous desulfonation. This problem is compounded by the fact that the preparation of alkylphenoxy sulfonic acids by sulfonation of the alkylphenol is generally conducted at elevated temperatures (e.g., >50° C.) and by the fact that it is common to store and/or ship these alkylphenoxy sulfonic acids at ambient conditions over long periods of time. In either case, a significant amount of the alkylphenoxy sulfonic acid can spontaneously desulfonate under these conditions.

Additionally, the commercial utility of neutral and low overbased alkylphenoxy sulfonate additive compositions is hindered by the fact that when prepared by current methodologies, these compositions can possess unacceptably high viscosities which require the further addition of large amounts of diluent to reduce the viscosity prior to the use of these compositions in formulating a complete lubricant package.

Specifically, neutral and low overbased alkylphenoxy sulfonate additive compositions have been typically prepared by first preparing the alkylphenol which is conventionally prepared by combining an excess amount of phenol with an olefin or alcohol in the presence of an acidic alkylation catalyst typically having a Hammett ($H_o$) acidity function of about −2.2 or greater (more positive) and an acid number of about 4.7 milliequivalents/gram or less. Such acidic alkylation catalysts include cross-linked polystyrene sulfonic acid resins (e.g., Amberlyst TM 15 resin - available from Rohm & Haas, Inc., Philadelphia, Pa. and which has an $H_o$ value of −2.2 and an acid number of about 4.7 milliequivalents per gram). The resulting alkylphenol is then sulfonated by conventional methodology to form the alkylphenoxy sulfonic acid which, in turn, is reacted with either a stoichiometric or excess amount of an alkaline earth metal base in the presence of minimal diluent oil. After completion of the reaction, additional diluent (e.g., diluent oil) is generally added. In any event, because of transport cost considerations, the resulting product preferably should contain no more than about 40 weight percent diluent oil. Under these conditions, however, the viscosity of the neutral alkylphenoxy sulfonate additive composition prepared by prior art techniques is significantly greater than about 1000 cSt at 100° C. and the viscosity of the low overbased salts, while somewhat less than that of the neutral salt, is nevertheless unacceptable.

Consequently, with prior art neutral and low overbased alkylphenoxy sulfonate additive compositions, it is conventional to add further amounts of an appropriate diluent to the additive composition to reduce its viscosity to acceptable ranges or to employ a minor amount of the neutral and low overbased alkylphenoxy sulfonate in combination with a salicylate (see, for example, British Pat. Appl. No. 1 372 532). One diluent typically employed is heavily branched alkylate bottoms (BAB-bottoms) which, by virtue of its branching and relatively low viscosity, lowers the viscosity of the additive composition.

The further addition of a suitable diluent, such as BAB-bottoms, is undesirable because it requires an additional step in the process and increases the cost of the overall process by requiring a component whose primary function is to reduce the viscosity of the additive composition. Likewise, the inclusion of a salicylate additive with a minor amount of a neutral or low overbased alkylphenoxy sulfonate is undesirable because it limits the formulator to using a salicylate in the lubricant composition particularly when the presence of salicylate is either unnecessary or undesirable.

In view of the above, neutral or low overbased alkylphenoxy sulfonate additive compositions having acceptable viscosities with minimal amounts of diluent or no salicylate would provide a significant advantage in the efficient use of these additive compositions. Additionally, neutral and low overbased alkylphenoxy sulfonate additive compositions prepared from alkylphenoxy sulfonic acids having improved stability against desulfonation would provide further advantages in the efficient manufacture, storage and shipment of these additive compositions.

SUMMARY OF THE INVENTION

This invention is based, in part, on the discovery that neutral and low overbased alkylphenoxy sulfonate additive compositions derived from alkylphenols prepared by reacting an olefin or alcohol with phenol in the presence of an acidic alkylation catalyst having a Hammett ($H_o$) acidity function of about −2.3 or less (more negative) have surprisingly lower viscosities as compared to neutral and low overbased alkylphenoxy sulfonate additive compositions derived from alkylphenols prepared by using acidic alkylation catalysts having a Hammett ($H_o$) acidity function of about −2.2 or more (more positive).

A preferred embodiment for this invention is based on the discovery that alkylphenoxy sulfonic acids containing an alkyl group derived from a substantially straight-chain olefin or alcohol provide enhanced stability against spontaneous desulfonation as compared to alkylphenoxy sulfonic acids containing an alkyl group derived from branched-chain olefins or alcohols.

A still further preferred embodiment of this invention is based on the discovery that the viscosity of neutral and low overbased alkylphenoxy sulfonate additive compositions can be reduced or further reduced by employing an alkylphenol which is obtained by reacting a substantially straight-chain internal olefin or alcohol with phenol for the preparation of such additive compositions.

In view of the above, in one of its composition aspects, this invention is directed to a lubricating oil soluble, neutral and low overbased alkylphenoxy sulfonate additive compositions which are prepared by the process of (a) forming a lubricating oil soluble alkylphenol by contacting an olefin or alcohol with phenol or a $C_1$to $C_7$ alkylphenol in the presence of an acidic alkylation catalyst having a Hammett (Ho) value of about −2.3 or less under conditions sufficient to cause alkylation of the phenol wherein the olefin or alcohol has a sufficient number of carbon atoms to impart oil solubility to the resulting alkylphenol;

(b) sulfonating the alkylphenol prepared in step (a) above so as to produce an alkylphenol sulfonic acid; and (c) neutralizing the product of step (b) with a sufficient amount of an alkaline earth metal base so that the resulting product has a TBN from 0 to about 100.

In another of its composition aspects, this invention is directed to a lubricating oil composition comprising from about 0.5 to about 40 weight percent of a lubricating oil soluble, neutral and low overbased alkylphenoxy sulfonate additive composition which is prepared by the process of (a) forming a lubricating oil soluble alkylphenol by contacting an olefin or alcohol with phenol or a $C_1$to $C_7$ alkylphenol in the presence of an acidic alkylation catalyst having a Hammett ($H_o$) value of about −2.3 or less under conditions sufficient to cause alkylation of the phenol wherein the olefin or alcohol has a sufficient number of carbon atoms to impart oil solubility to the resulting alkylphenol;

(b) sulfonating the alkylphenol prepared in step (a) above so as to produce an alkylphenol sulfonic acid; and (c) neutralizing the product of step (b) with a sufficient amount of an alkaline earth metal base so that the resulting product has a TBN from 0 to about 100.

In one of its method aspects, this invention is directed to a method for reducing the viscosity of a lubricant additive composition comprising neutral and low overbased alkylphenoxy sulfonates which method comprises the steps of:

(a) forming a lubricating oil soluble alkylphenol by contacting an olefin or alcohol with phenol or a $C_1$to $C_7$ alkylphenol in the presence of an acidic alkylation catalyst having a Hammett ($H_o$) value of about −2.3 or less under conditions sufficient to cause alkylation of the phenol wherein the olefin or alcohol has a sufficient number of carbon atoms to impart oil solubility to the resulting alkylphenol;

(b) sulfonating the alkylphenol prepared in step (a) above so as to produce an alkylphenol sulfonic acid; and (c) neutralizing the product of step (b) with a sufficient amount of an alkaline earth metal base so that the resulting product has a TBN from 0 to about 100.

Preferably, the acidic alkylation catalyst has a Hammett ($H_o$) value of about −2.5 or less and more preferably, has a Hammett ($H_o$) value of about −4 or less.

In another preferred embodiment, the acidic alkylation catalyst further has an acid number of at least 5 milliequivalents per gram.

The compositions of this invention typically possess a viscosity at 100° C. in 40 weight percent of diluent of less than 1000 cSt.

DETAILED DESCRIPTION OF THE PREFERRED EMBODIMENTS

This invention is directed to novel neutral and low overbased alkylphenoxy sulfonate additive compositions which, at equal diluent oil concentrations, have surprisingly reduced viscosities as compared to neutral and low overbased alkylphenoxy sulfonate additive compositions heretofore produced. However, prior to discussing this invention in detail, the following terms will first be defined:

Definitions

As used herein, the term "Total Base Number" or "TBN" refers to the amount of base equivalent in milligrams of KOH in 1 gram of additive. Thus, higher TBN numbers reflect more alkaline products and therefore a greater alkalinity reserve. The Total Base Number for an additive composition is readily determined by ASTM test method D664 or other equivalent methods.

The term "acid number" refers to the amount of acid equivalent in milliequivalents of proton in 1 gram of acidic alkylation catalysts and, accordingly, the acid number value is reported as milliequivalents per gram. The acid number for an acidic alkylation catalyst resin is readily determined by ASTM test number D664 as modified in the manner of Example A set forth hereinbelow or other equivalent methods.

The term "alkaline earth metal" or "Group II metal" means calcium, barium, magnesium, and strontium. Preferably, the Group II metal is selected from the group consisting of calcium, magnesium, barium, and mixtures thereof. Most preferably, the Group II metal is calcium.

The term "neutral and low overbased alkylphenoxy sulfonate additive compositions" refers to compositions prepared by neutralizing an alkylphenol sulfonic acid with an alkaline earth metal base, such as an alkaline earth metal oxide, in the presence of diluent oil. The use of a stoichiometric equivalent (i.e., the exact amount of alkaline earth metal necessary to neutralize all of the alkylphenol sulfonic acid) provides for a "neutral" alkylphenoxy sulfonate; whereas an excess of alkaline earth metal so that the resulting product has a TBN of about 100 or less, and preferably about 50 or less, provides for a "low overbased" alkylphenoxy sulfonate.

As is apparent, the neutral and low overbased alkylphenoxy sulfonate additives described herein contain diluent oil and the term "neutral and low overbased alkylphenoxy sulfonate additive compositions" is defined to include such diluent oil. Typically, such compositions are manufactured to contain some diluent oil and, after manufacture, additional amounts of diluent oil are added to provide for an additive composition having from about 5 to about 40 weight percent diluent oil. As such, these additive compositions contain concentrated amounts of the alkylphenoxy sulfonate of which only a small amount is added together with other additives to a lubricating oil so as to provide for a fully formulated lubricant composition suitable for use in the crankcase of an internal combustion engine.

When the viscosity of the neutral or low overbased alkylphenoxy sulfonate additive composition is too high (i.e., 1000 cSt or higher at 100° C.), these compositions are difficult to manipulate (e.g., pour) in lubricant blending procedures used to prepare a fully formulated lubricant composition. Accordingly, in these circumstances, it is necessary to add additional amounts of low viscosity diluent to the additive composition so as to lower its viscosity thereby allowing for facile manipulation of the additive composition.

In this regard, the neutral and low overbased alkylphenoxy sulfonate additive compositions produced herein typically possess a viscosity at 100° C. in the presence of 40 weight percent diluent oil of less than 1000 cSt and, accordingly, do not generally require the addition of further amounts of low viscosity diluent to lower viscosity. In contrast, known neutral and low overbased alkylphenoxy sulfonate additive compositions derived from alkylphenols prepared by reacting an olefin or an alcohol with phenol in the presence of an acidic alkylation catalyst having a Hammett ($H_o$) value of $-2.2$ or more (more positive) generally possess a viscosity at 100° C. and in the presence of 40 weight percent diluent oil which is greatly in excess of 1000 cSt. Under these circumstances, additional low viscosity diluent is necessarily added to lower the viscosity of such additive compositions so as to permit their facile manipulation during formulation procedures.

In regard to the above, the viscosity of neutral and low overbased alkylphenoxy sulfonate additive compositions of this invention will vary with temperature and diluent concentration. However, neutral and low overbased alkylphenoxy sulfonate additive compositions having a viscosity of about 1000 cSt at 100° C. and 40 weight percent diluent oil define a class of additive compositions which possess acceptable viscosity over a range of temperatures and a range of diluent oil concentrations. See, for example, U.S. Ser. No. 07/938,779 which application is incorporated herein by reference in its entirety.

The low overbased alkylphenoxy sulfonate additive compositions described herein have a Total Base Number of about 100 or less wherein all or part of the TBN is attributable to the excess of alkaline earth metal. Optionally, however, low overbased alkylphenoxy sulfonates can be prepared by using an equivalent or excess amount of alkaline earth metal and are then further treated with carbon dioxide and/or sulfur in a manner known per se provided that the total TBN is about 100 or less. Preferably, however, all of the TBN of the low overbased alkylphenoxy sulfonate is attributable solely to an excess of alkaline earth metal over that necessary to neutralize all of the sulfonic acid in the alkylphenol sulfonic acid.

The term "substantially straight-chain alkyl group" means an alkyl group which is attached to the phenolic ring through a secondary, tertiary or quaternary carbon atom and which contains minimal branching in the remainder of the carbon atoms of the alkyl group [i.e., less than 20% of the remaining carbon atoms are tertiary and/or quaternary carbon atoms in the molecular structure of the alkyl group]. Suitable substantially straight-chain alkyl groups include, for example, 1-decyl [$-CH_2(CH_2)_8CH_3$] (0% of the carbon atoms are tertiary or quaternary carbon atoms), 4-methyl-1-decyl [$—CH_2(CH_2)_2CHCH_3(CH_2)_5CH_3$] (9% of the carbons are branched), etc.

Preferably, the substantially straight-chain alkyl group contains less than 15% tertiary and/or quaternary carbon atoms in the remainder of the alkyl group; more preferably, less than 10%; still more preferably, less than 5%; and most preferably, the substantially straight-chain alkyl group contains no tertiary or quaternary carbon atoms in the remainder of the alkyl group.

Substantially straight-chain alkyl groups are preferably prepared by reacting phenol with either a substantially straight-chain alpha olefin, a substantially straight-chain alcohol, or a substantially straight-chain internal olefin or alcohol.

The term "olefin" refers to hydrocarbons containing a monoolefin group (C=C) within its structure.

The term "alcohol" refers to alkyl groups containing an —OH substituent.

The term "alpha olefin" refers to hydrocarbons containing a monoolefin group at one of the terminal portions of the hydrocarbon so as to terminate in a $CH_2{=}CH{-}$ group. Examples of alpha olefins include 1-decene [$(CH_2{=}CH(CH_2)_7CH_3$], 1-hexadecene [$(CH_2{=}CH(CH_2)_{13}CH_3$], and the like.

The term "substantially straight-chain alpha olefin" means an alpha olefin which contains minimal branching [i.e., less than 20% of the carbon atoms are tertiary and/or quaternary carbon atoms] in its molecular structure.

The term "substantially straight-chain alcohol" means an alcohol which contains minimal branching [i.e., less than 20% of the carbon atoms are tertiary and/or quaternary carbon atoms] in the molecular structure.

The term "internal olefins" means an olefin wherein the double bond is at other than the 1, 2 or 3 position of the alkene; whereas the term "internal alcohol" means that the alkyl group contains the alcohol substituent at other than the 1, 2, or 3 position of the alcohol. By the same token, the term "internal attachment" implies that the olefin or alcohol attaches to the phenoxy group at a carbon other than the 1, 2 or 3 position of the alkyl substituent resulting from olefin or alcohol attachment to the phenol.

The term "oil solubility" means that the additive has a solubility of at least 50 grams per kilogram and preferably at least 100 grams per kilogram at 20° C. in a base 10W40 lubricating oil.

The term "substantially stable" as it relates to the stability of the alkylphenoxy sulfonic acid to spontaneous desulfonation means that less than 20% of the this composition will desulfonate when stored at 66° C. for 48 hours under the conditions of Example 5.

Methodology

The low viscosity, neutral and low overbased alkylphenoxy sulfonate additive compositions described herein are obtained by first preparing alkylphenols which, in turn, are then sulfonated by methods known in the art to provide for alkylphenoxy sulfonic acids. Reaction of the alkylphenoxy sulfonic acids with a stoichiometric equivalent or excess amount of an alkaline earth metal base in the presence of diluent oil provides for the neutral and low overbased alkylphenoxy sulfonate additive compositions.

Alkylphenols

Specifically, the preparation of the alkylphenol employed in this invention is accomplished by alkylation of phenol or a $C_1$ to $C_7$ alkyl substituted phenol with an olefin or an alcohol in the presence of an acidic alkylation catalyst having a Hammett ($H_o$) acidity function of $-2.3$ or less. Preferably, the acidic alkylation catalyst further has an acid number of about 5.0 milliequivalents per gram and greater.

Suitable acidic alkylation catalysts having a Hammett ($H_o$) acidity function of $-2.3$ or less are well known in the art and include Nafion TM (a fluorocarbonsulfonic acid polymer heterogeneous acid catalyst available from DuPont, Wilmington, Del.), Amberlyst TM 36 resin (a sulfonic acid resin available from Rohm & Haas, Philadelphia, Pa.) and the like.

Typically, an excess of phenol (to the olefin or alcohol) is employed in this process and, in a preferred embodiment, the reaction employs at least about 1.1 moles of phenol per mole of olefin or alcohol. In a more preferred embodiment, the reaction employs at least about 3 moles of phenol per mole of olefin or alcohol. In this regard, particularly good results are obtained by using about 3.5 moles of phenol per mole of olefin or alcohol. Typically, upon reaction completion, the unreacted phenol is recovered (e.g., by distillation), and can be recycled.

In a preferred embodiment, the alkylated phenol is alkylated with an olefin or alcohol having at least about 8 carbon atoms and more preferably at least 10 carbon atoms. In a particularly preferred embodiment, the olefin or alcohol contains at least about 18 carbon atoms, and still even more preferably the olefin or alcohol employed is a mixture of olefins or alcohols containing between 20 and 28 carbon atoms.

The olefin or alcohol is preferably a substantially straight-chain olefin or alcohol and more preferably is a straight-chain olefin or alcohol. The substantially straight-chain olefin or straight-chain olefin can be either an alpha olefin or an internal olefin. Similarly, the substantially straight-chain alcohol or straight-chain alcohol can have the hydroxyl substituent at either terminus (i.e., the 1- position) or internally.

The reaction is generally conducted at a temperature of above about 80° C. and preferably from above about 90° C. and still even more preferably above about 90° C. to about 120° C, and yet even more preferably from about 100° C. to about 110° C.

The reaction is typically conducted in either a batch or a continuous process. In batch processes, the reagents are combined into a single vessel and the reaction is maintained at the selected reaction temperature for about 8 to about 10 hours. In a continuous process, a reagent stream containing the requisite amounts of olefin and phenol or $C_1$ to $C_7$alkylphenol is passed through a stationary bed of acidic alkylation catalyst as defined above typically at a LHSV of from about 0.2 to about 0.5 $hr^{-1}$. In such processes, the contact time is generally from about 2 to about 5 hours and preferably around 3 hours.

In either case, after reaction completion, the product alkylphenol can be separated by conventional methods such as distillation, chromatography, and the like or used in the next step without further purification and/or isolation.

The resulting alkylphenols prepared by this process comprise monoalkylate phenols and dialkylated phenols. That is to say that one or two alkyl groups have been added to the phenol or $C_1$ to $C_7$ alkylphenol. The monoalkylated phenols typically are alkylated at either the 2 (ortho) or 4 (para) positions. The dialkylated phenols prepared by this process are typically alkylated at either the 2,4- or the 2,6-positions. Preferably, monoalkylation is in the 4-position and dialkylation is in the 2,4-positions.

Surprisingly, at reaction temperatures greater than about 90° C. and preferably greater than 100° C., it has been found that acidic alkylation catalysts having a Hammett ($H_o$) acidity function of about $-2.3$ or less (more negative) and preferably having an acid number of about 5.0 milliequivalents per gram or more provide for enhanced dialkylation of phenol or $C_1$ to $C_7$ phenol. At these temperatures, the resulting alkylphenol has been found to typically contain about 10 weight percent or more dialkylation.

Contrarily, acidic alkylation catalysts having a Hammett ($H_o$) acidity function of about $-2.2$ or more (more positive) and preferably having an acid number of about 4.7 or less as heretofore used to prepare alkylphenols for subsequent conversion to neutral and low overbased alkylphenoxy sulfonate additive compositions have been found to typically contain less than about 5 weight percent dialkylation.

Without being limited to any theory, it is believed that the enhanced amount of dialkylation of the phenolic group arising from using the acidic alkylation catalysts described herein is at least partially responsible for the reduced viscosity of the resulting neutral and low overbased alkylphenoxy sulfonate additive compositions.

Again, without being limited to any theory, it is believed that the enhanced amount of dialkylated phenol arises because the enhanced acidity of the acidic alkylation catalyst used in this invention as compared to the acidic alkylation catalyst heretofore used to alkylate phenol for subsequent conversion to alkylphenoxy sulfonic acids.

As noted above, acidic alkylation catalysts having a Hammett acidity function of less than −2.3 are known in the art and include Nafion TM (commercially available from DuPont, Wilmington, Del.) and Amberlyst TM 36 resin (commercially available from Rohm & Haas, Philadelphia, Pa.). It is further noted that while Amberlyst TM 36 resin has heretofore been commercially employed to prepare alkylphenol, this resin has not been employed to prepare alkylphenols for subsequent use in the preparation of neutral and low overbased alkylphenoxy sulfonate additive compositions.

Sulfonated Alkylated Phenols

The alkylated phenols prepared as above are then converted to the alkylphenol sulfonic acids by standard, well-known sulfonation chemistry. Specifically, the alkylphenol sulfonic acids are prepared by reacting the alkylated phenol with a suitable sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil soluble alkylphenol sulfonic acid.

The subsequent neutralization reaction is conventional and is described by Leone et al., U.S. Pat. No. 4,751,010 which is incorporated herein by reference in its entirety. In general, the neutralization reaction involves the addition of a suitable amount of one or more alkaline earth metal bases such as alkaline earth metal oxides, hydroxides, carbonates, chlorides, etc., to the alkylphenol sulfonic acid. The reaction temperature is not critical provided that the reaction is conducted at a temperature sufficient to cause neutralization. Preferably, the reaction is conducted at a temperature of at least 55° C. and preferably from about 55° C. to about 140° C. and more preferably from about 55° C. to about 85° C. and is generally complete within about 1–6 hours.

The reaction is generally conducted in a diluent oil optionally in the presence of one or more inert diluent solvents, including by way of example, methanol, xylene, toluene, hexane, 2-ethylhexanol, oxoalcohols, decyl alcohol, tridecyl alcohol, 2-butoxyethanol, 2-butoxypropanol, the methyl ether of propylene glycol and mixtures thereof.

The amount of diluent oil employed is generally from about 5 to 40 weight percent of the total weight of the reaction mixture in the absence of inert diluent solvent whereas the amount of inert diluent solvent is generally an amount to ensure efficient mixing of the reagents. The diluent oil generally has a viscosity of from about 2 to about 10 cSt at 100° C. and is preferably, the same oil that will be used to prepare the fully formulated lubricating oil composition.

The neutralization can be catalyzed by means of carboxyl (COOH) ions from carboxylic acids, such as formic acid, acetic acid, glycolic acid; halogen ions, such as chlorides introduced by means of ammonium, calcium, or zinc chloride; or amine ($-NH_2$) functional groups such as polyethylene polyamines and tris(2-oxa-6-aminohexyl)amine. If a catalyst is used, the amount of catalyst used should be up to about 0.1 mole of carboxyl or halide ion or amine functional group per mol of initial alkylphenol sulfonic acid.

After reaction completion, the solids are generally removed by conventional means (i.e., filtration, centrifugation, etc.) and the inert diluent solvent is removed by conventional means such as stripping under reduced pressure. The recovered product is a neutral or low overbased alkylphenoxy sulfonate which is dissolved in diluent oil.

In an optional embodiment, the neutral or low overbased alkylphenoxy sulfonate additive composition described herein can be used to prepare low, moderately or highly overbased alkylphenoxy sulfonate additive compositions by first adding an excess amount of alkaline earth metal base to form the low overbased alkylphenoxy sulfonate, optionally adding sulfur, and then adding carbon dioxide. In general, from about 0 to about 1.5 equivalents of sulfur are added to the reaction mixture and the sulfur addition step is generally conducted at a temperature of about 100° C. to about 200° C. Likewise, from 0 to about 10 equivalents of carbon dioxide are generally then added to the reaction mixture and the carbonation step is generally conducted at from about 145° C. to about 180° C.

When the resulting composition has a TBN of about 100 or less, it is considered a "low overbased alkylphenoxy sulfonate additive composition"; whereas when the composition has a TBN of greater than about 100 and less than about 300, it is considered a "moderately overbased alkylphenoxy sulfonate additive composition"; and when the composition has a TBN of greater than 300, it is considered a highly overbased alkylphenoxy sulfonate additive composition. Preferably, the highly overbased alkylphenoxy sulfonates have a TBN of from about 300 to about 500.

It is contemplated that the highly overbased alkylphenoxy sulfonates will have a viscosity lower than that achieved by highly overbased alkylphenoxy sulfonates heretofore produced using conventional alkylphenol sulfonic acids. In this embodiment, calcium hydroxide or oxide is the most commonly used alkaline earth metal base and the addition of carbon dioxide can be preceded by the addition of sulfur to form a sulfurized low overbased alkylphenoxy sulfonate.

Methods for the addition of carbon dioxide and optionally sulfur to the alkylphenoxy sulfonates are well known in the art and are described, for example, by De Vault, U.S. Pat. No. 3,523,898; by Leone et al., U.S. Pat. No. 4,751,010; and by European Patent Application No. 0 003 694, the disclosures of each are incorporated herein by reference in its entirety.

At equivalent amounts of the same diluent oil, the neutral and low overbased alkylphenoxy sulfonates of this invention possess surprisingly lower viscosities as compared to prior art neutral and low overbased alkylphenoxy sulfonates. Additionally, when the neutral and low overbased alkylphenoxy sulfonates of this invention are prepared in the presence of at least 5 weight percent diluent oil, these additives are of sufficiently low viscosity that the further addition of supplemental low viscosity diluents is not necessary. This is especially surprising for the neutral alkylphenoxy sulfonates which have the highest viscosity (i.e., the viscosity of these additives increases as the TBN is reduced).

Because the viscosity of low overbased alkylphenoxy sulfonate additive compositions are invariably less than that of the corresponding neutral alkylphenoxy sulfonate additive compositions, alkylated phenols prepared by the methods described herein provide for neutral and low overbased alkylphenoxy sulfonate additive compositions having viscosities which require the addition of substantially less or no diluents such as BAB-bottoms or the like to reduce the viscosity to a point where it can be readily manipulated for formulation purposes. This is especially surprising when it is considered that such a viscosity is achieved despite the fact that the TBN may be less than about 100, and, as indicated above, the TBN may be as low as approximately 0.

When olefins or alcohols are employed to alkylate phenol or a $C_1$ to $C_7$ alkylphenol, the olefins or alcohols are substantially straight-chain olefins or alcohols. From an availability point of view, it is preferred that the olefins are substantially straight chain α-olefins and that the alcohols have the —OH substituent at the 1-position.

Contrarily, from a viscosity point of view, it is contemplated that substantially straight-chain internal olefins and internal alcohols provide for enhanced internal attachment which, in turn, is believed to provide for an incremental reduction in viscosity as compared to end attachment. Thus, the alkyl group according to the preferred embodiment of this invention is attached at an internal carbon atom, i.e., other than the terminal 1, 2 or 3 positions from either end of the alkyl group.

Where the starting material is an α-olefin, this internal attachment can occur by migration of the carbonium ion formed from the α-olefin during alkylation.

The oil-soluble, neutral and low overbased alkylphenoxy sulfonate additive compositions produced by the process of this invention are useful lubricating oil additives imparting detergency and dispersency properties when added to the lubricating oil employed in the crank case of an internal combustion engine. When employed in this manner, the amount of oil-soluble, neutral and low overbased alkylphenoxy sulfonate added to the lubricating oil composition ranges from about 0.5 to 40 weight percent of the total lubricant composition although preferably from about 1 to 25 weight percent of the total lubricant composition. Such lubricating oil compositions are useful in diesel engines, gasoline engines as well as in marine engines.

Such lubricating oil compositions employ a finished lubricating oil which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like.

The lubricating oils used in such compositions may be mineral oils or synthetic oils of viscosity suitable for use in the crank case of an internal combustion engine such as gasoline engines and diesel engines which include marine engines. Crank case lubricating oils ordinarily have a viscosity of about 1300 cSt at 0° F. to 24 cSt at 210° F. (99° C.). The lubricating oils may be derived from synthetic or natural sources. Mineral oils for use as the base oil in the invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of α-olefins having the proper viscosity. Especially useful are the hydrogenated liquid oligomers of $C_6$ to $C_{12}$ α-olefins such as 1-decene trimer. Likewise, alkylbenzenes of proper viscosity such as didodecyl benzene, can be used. Useful synthetic esters include esters of both monocarboxylic acids and polycarboxylic acids as well as monohydroxy alkenols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° .F) mineral oil gives an excellent lubricating oil base.

Other additives which may be present in the formulation include rust inhibitors, foam inhibitors, corrosion inhibitors, metal deactivators, pour point depressants, anti-oxidants, and a variety of other well-known additives.

The invention will be illustrated in greater detail by the following specific examples. It is understood that these examples are given by way of illustration only and are not meant to limit the disclosure of the claims to follow.

EXAMPLES

EXAMPLE A

DETERMINATION OF ACID NUMBERS

The acid numbers reported herein were determined by ASTM test D664 modified as follows:

1. Add 22 cc of 10% aqueous sodium chloride to 1.0 gram of catalyst. The mixture is allowed to stand overnight. Care is taken to ensure that static charge does not effect sample weights and that all beads are thoroughly soaked in the aqueous solution.
2. Carefully pipet 2.0 to 5.0 cc of the above brine solution and titrate to a phenolphalein end-point with 0.100N KOH.
3. Use the D664 formula for acid number determination.

EXAMPLE 1

PREPARATION OF LOW OVERBASED ALKYLPHENOXY SULFONATES

A. Preparation of Alkylate Phenols

Low overbased (LOB) alkylphenoxy sulfonates were prepared using an alkylphenol derived by contacting 3.5 moles of phenol per each mole of a $C_{20}$ to $C_{24}$ alpha olefin mixture using either an Amberlyst-15 catalyst [a polystyrene cross-linked sulfonic acid resin having a Hammett acid function ($H_o$) of −2.2 and an acid number of 4.7 milliequivalents per gram] or Amberlyst-36 catalyst [a polystyrene cross-linked sulfonic acid resin having a Hammett acid function ($H_o$) of less than −2.2 and an acid number of 5.4 milliequivalents per gram]. Both Amberlyst-15 and Amberlyst-36 resin catalysts are commercially available from Rohm & Haas, Philadelphia, Pa. Amberlyst-15 represents a typical prior art alkylation catalyst used in the preparation of alkylphenols which are subsequently converted to neutral and low overbased alkylphenoxy sulfonate additve composition.

The alkylation reactions were conducted at 10° C. increments using a continuous alkylation unit such that the catalyst contact time was 3 hours and the LHSV was 0.33 $hr^{-1}$. The quoted column temperature was maintained as the average temperature measured at the lower third and the upper third of the reactor. Afterwards, the alkylated phenol was recovered by stripping the excess phenol from the product stream which optionally can be recycled for further use. The recovered alkylphenol products were analyzed for dialkyl content and ortho/para substitution by high performance liquid chromatography (HPLC) using a cyano column (Beckman 4.6 mm×25 cm Ultrasphere Cyano, Beckman Instruments, San Ramon, Calif.). The eluant employed was a solvent mixture comprising:

10 vol. %—2.5 volume % absolute EtOH in cyclohexane 90 vol. %—cyclohexane

The flowrate was 1.5 ml/minute and the sample concentration at the injection port was 0.01 volume percent in cyclohexane. The detection system comprised a UV/VIS detector set at a wavelength of 281 nm.

The results of this analysis are set forth in Table I below:

TABLE I

| Temperature (°C.) | % Dialkylation Amberlyst 15 | Amberlyst 36 |
|---|---|---|
| 80 | <3 | <1 |
| 90 | <4 | 6 |
| 100 | 4 | 11 |
| 110 | <3 | 15.5 |
| 120 | <2 | 15 |
| 120 | <2 | 15 |
| 130 | <4 | 13 |
| 140 | <3 | 19.5 |

The above data shows that at reaction temperatures of greater than about 100° C., alkylation with Amberlyst TM 36 catalyst provides for greater than 11 percent dialkylation whereas the prior art catalyst consistently provides about 4 weight percent or less of dialkylation.

Additionally, both catalysts gave essentially identical ratios of [ortho/(ortho+para)] isomers and these ratios were nearly independent of temperature over the range indicated.

B. Sulfonation of Alkylated Phenols

Alkylated phenols prepared in a manner consistent with Example 1A above (at 140° C.) were sulfonated by adding the appropriate alkylated phenol to a reaction flask immersed in a 55° C. water bath. Air was introduced into the reaction flask at a rate of 5 liters per minute. Sufficient $SO_3$ was added to the reaction flask at a rate of 0.157 ml/minute so as to provide a charge mole ratio of $SO_3$ to alkylated phenol of 1.1:1. After completion of the $SO_3$ charge, the reaction is maintained at 55° C. for 15 minutes. Cyclohexamine analysis for this product indicates that 81.64 weight percent of this product is the desired alkylphenol sulfonic acid.

C. Neutralization

Alkylphenol sulfonic acids produced in the manner similar to Step B above were neutralized with an excess of calcium hydroxide to provide for a low overbased alkylphenoxy sulfonate. Typically, 104.5 grams of alkylphenoxy sulfonic acid is charged to a 3-neck 2-liter flask as well as 64.4 g of diluent oil (CitCon 100N). To this system is added 500 ml of 1:1 methanol:xylene and 2.1 g of 40% calcium chloride. The system is then heated to about 40° C. and 8.42 g of $Ca(OH)_2$ is then added over a thirty minute period. The system is then heated to 60° C. and then 0.51 g of additional $Ca(OH)_2$ is added and the system is maintained at 60° C. for 30 minutes. Afterwards, the system is heated to 80° C. and is maintained at this temperature for 1 hour; is heated to 100° C. and is maintained at this temperature for 1 hour. At this point, the methanol/water is removed. The system is then centrifuged at 6000 rpm for 30 minutes to remove insolubles and the liquid decanted off. Xylene is then removed by stripping under reduced pressure to provide for a low overbased alkylphenoxy sulfonate. Sufficient diluent oil (CitCon 100N) is then added to provide for low overbased alkylphenoxy sulfonates of approximately equivalent calcium concentration.

Different low overbased alkylphenoxy sulfonates were prepared by procedures similar to that recited above. These low overbased alkylphenoxy sulfonates were then analyzed for TBN values, weight percent calcium and viscosity at 100° C. The results of this analysis are set forth in Table II as follows:

TABLE II

| LOW OVERBASED ALKYLPHENOXY SULFONATES PREPARED FROM: | Alkylated Phenol from Amberlyst 15 | Alkylated Phenol from Amberlyst 36 |
|---|---|---|
| TBN | 5.6 | 7.0 |
| HYAMINE Ca | 1.91% Ca | 1.63% Ca |
| Analysis | | |
| VIS (@ 100° C.) | 1787 cSt | 97.3 cSt |

The results of this example demonstrate that the low overbased alkylphenoxy sulfonate additve compositions derived from an acidic alkylation catalyst having a Hammett acid function ($H_o$) of less than −2.2 provides for additive compositions having significantly lower viscosities as compared to low overbased alkylphenoxy sulfonates prepared from acidic alkylation catalysts having a Hammett acid function ($H_o$) of −2.2 or more.

EXAMPLE 2

PREPARATION OF OVERBASED ALKYLPHENOXY SULFONATE ADDITIVE COMPOSITION

Alkylphenol sulfonic acid produced in the manner similar to Step B of Example 1 above was neutralized with an excess of calcium hydroxide to provide for a low overbased alkylphenoxy sulfonate additive composition. In this example, 307.4 grams of diluent oil (CitCon 100N oil) is combined with 33.0 grams of lime in a 2 liter round bottom flask. The system is heated to 32° C. and then heated to 85° C. over a 30 minute period and then 358.7 grams of alkylphenoxysulfonic acid (3.31% calcium-sulfur by Hyamine analysis) is added dropwise via a dropping funnel to the reaction mixture. Upon complete addition, the system is heated to 95° C. over 15 minutes and then cooled to 85° C. At this point, 51.12 grams of 2-ethylhexanol is added over a 3 minute period. Then, 9.21 grams of calcium chloride in 21.34 grams of water is added over a 2 minute period, followed by addition of 3.88 grams of 1:1 formic acid:acetic acid over a 2 minute period.

Upon completion of this addition process, the system is refluxed at 95° C. for 1.5 hours. Afterwards, the diluents (other than CitCon 100N) are removed by distillation, first by heating to 121° C. over a 20 minute period and holding at this temperature for 15 minutes; and then by heating the system to 204° C. over 1 hour and stripping at 204° C. and 25 mm Hg for 1 hour to provide for a low overbased alkylphenoxy sulfonate additive composition.

EXAMPLE 3

PREPARATION OF OVERBASED ALKYLPHENOXY SULFONATE ADDITIVE COMPOSITION CONTAINING CARBON DIOXIDE

To a 2 liter, 4-neck round bottom flask were added 100 grams of methanol, 480 grams of xylene, and 90 grams of Mississippi Lime (Mississippi Lime Company, Ste. Genevieve, Mo.). The resulting system was stirred for 10 minutes. Afterwards, 266 grams of alkylphenoxy sulfonic acid [3.1% CaS by Hyamine analysis - prepared in a manner similar to that of Example 1, steps (a) and (b)] was slowed added to the system, over about a 1.5 hour period, while maintaining a maximum temperature of 31° C.

At this point, carbonation was initiated and approximately 28 grams of carbon dioxide were added at the following rates:

17.5 grams $CO_2$ at 0.295 grams/minute
2.4 grams $CO_2$ at 0.224 grams/minute
2.8 grams $CO_2$ at 0.183 grams/minute
2.8 grams $CO_2$ at 0.140 grams/minute
2.8 grams $CO_2$ at 0.061 grams/minute Upon completion of the carbonation step, the system was heated to 93° C. over a 2 hour period and then heated to 132° C. over a 30 minute period. At this point, 155 grams of diluent oil, CitCon 100N, was added and the system heated to 204° C. over 1.5 hours under vacuum to strip of the xylene. The resulting solution was then filtered over Celite TM (diatomaceous earth available from Manville Corporation) so as to provide an overbased carbon dioxide containing alkylphenoxy sulfonate additive composition having a TBN of about 200, a viscosity at 100° C. of 166 cSt (average of 2 runs —108 cSt and 223 cSt respectively), and 1.8% Ca-S by Hyamine analysis.

EXAMPLE 4

PREPARATION OF OVERBASED SULFURIZED CARBON DIOXIDE CONTAINING ALKYLPHENOXY SULFONATE ADDITIVE COMPOSITION

Lime (74 grams), sulfur (17 grams), decanol (214 grams) and diluent oil (211 grams Chevron 100N -available from Chevron USA, Inc., Richmond, Calif.) were combined and heated to 180° F. (82° C.). At this point, 165 grams of alkylphenoxy sulfonic acid, prepared in a manner similar to steps (a) and (b) of Example 1 above, were added over a 20 minute period and then the reaction mixture was stirred for an additional 10 minutes. Afterwards, 43 grams of ethylene glycol were added dropwise to the reaction system over a 45 minute period. The system was then heated to 350° F. (176.6° C.) and maintained at this temperature for 40 minutes.

At this time, the carbonation of this system was initiated by bubbling $CO_2$ into the system at a rate of 0.12 grams/minute for a total duration of 30 minutes and then an additional 17.9 grams of $CO_2$ was added to the system at a rate of 0.175 gram/minute so as to provide a total amount of 21.5 grams of $CO_2$. Afterwards, the reaction was heated to 410° F. and stripped at 25 millibar pressure for 15 minutes and then filtered through Celite TM.

The resulting overbased sulfurized alkylphenoxy sulfonate additive composition of this example has a TBN of 176, a calcium content of 8.79% and a viscosity of 66 cSt at 100° C.

As is apparent from Examples 1–4, the neutral and overbased alkylphenoxy sulfonates of this invention are prepared in the absence of other additives such as salicylates and, accordingly, the resulting additive composition is free of salicylates.

EXAMPLE 5

STABILITY OF SUBSTANTIALLY STRAIGHT-CHAIN ALKYLPHENOXY SULFONIC ACID

This example evaluates the stability of substantially straight-chain alkylphenoxy sulfonic acid to thermal desulfonation as compared to the degree of thermal desulfonation resulting from branched alkylphenoxy sulfonic acid. Specifically, this example evaluates the thermal stability of a straight-chain alkylphenoxy sulfonic acid which was prepared by first alkylating phenol with an alpha olefin mixture comprising alpha olefins of from 20 to 24 carbon atoms in the presence of Amberlyst TM 36 catalyst resin. The resulting alkylphenol comprises at least 10% dialkyl substitution, i.e., n in formula I is at least 1.1. The alkylphenol was then converted to its sulfonic acid by contacting the alkylphenol with 1.03 equivalents of $SO_3$ using conventional methods, i.e., either a batch method similar to that of step (b) of Example 1 or a standard falling film process. This compound is hereafter referred to as Compound I.

The thermal stability of this sulfonic acid was compared to an alkylphenoxy sulfonic acid obtained in a manner similar to that of Compound I except that this compound employed an alkylphenol derived from propylene tetramer. This compound contains about 27% tertiary carbon atoms in the alkyl group other than at the point of attachment to the phenolic ring and, accordingly, is not a substantially straight-chain alkyl substituent. This compound is hereafter referred to as Compound II.

The stability of Compound I and Compound II against spontaneous desulfonation was measured by placing a sample of each compound in a temperature controlled oven at about 66° C. (150° F.). The sample was maintained in the oven for 24 hours and 48 hours and, at each interval, the sulfonic acid content was determined titrimetrically as the weight percent calcium as sulfonate following the published procedure of Yamaguchi et al., Journal of the American Oil Chemists Society, Volume 55, page 359 (1977). The results of this analysis are set forth in Table III below:

TABLE III

| | Wght. % Calcium as Sulfonate | | | |
|---|---|---|---|---|
| Compound No. | 0 hours | 24 hours | 48 hours | % Loss[1] |
| I | 3.65 | 3.36 | 3.28 | ~10% |
| II | 4.56 | 3.13 | 2.58 | ~43% |

[1]% Loss is determined by subtracting the weight percent calcium as sulfonate at 48 hours from that at 0 hours; dividing this result by weight percent calcium as sulfonate at 0 hours and multiplying this result by 100.

The above results demonstrate that the amount of sulfonic acid group retained in the alkylphenoxy sulfonic acid is substantially greater for Compound I as compared to Compound II and, accordingly, this data substantiates that alkylphenoxy sulfonic acids containing a substantially straight-chain alkyl group are more stable against spontaneous desulfonation as compared to alkylphenoxy sulfonic acids containing a branched chain alkyl group.

While the invention has been described in terms of various preferred embodiments, the skilled artisan will appreciate that various modifications, substitutions, omissions, and changes may be made without departing from the spirit thereof. Accordingly, it is intended that the scope of this invention be limited solely by the scope of the following claims, including equivalents thereof.

What is claimed is:

1. A lubricating oil soluble, neutral and low overbased alkylphenoxy sulfonate additive composition having a viscosity of no more than about 1000 cSt at 100° C. in the presence of 40 weight percent diluent oil wherein said diluent oil has a viscosity of from about 2 to about 10 cSt at 100° C. which composition is prepared by the process of (a) forming a lubricating oil soluble alkylphenol by contacting an olefin or alcohol with phenol or a $C_1$ to $C_7$ alkylphenol in the presence of an acidic alkylation catalyst characterized as having a Hammett ($H_o$) value of about −2.3 or less at a temperature of above about 90° C. and under conditions sufficient to cause alkylation of the phenol wherein the olefin or alcohol has a sufficient number of carbon atoms to impart oil solubility to the resulting alkylphenol;

(b) sulfonating the alkylphenol prepared in (a) above so as to produce an alkylphenol sulfonic acid; and (c) neutralizing the product prepared in (b) above with the sufficient amount of an alkaline earth metal base so that the resulting product has a TBN from 0 to about 100.

2. An additive composition according to claim 1, wherein the acidic alkylation catalyst is further characterized as having an acid number of 5.0 milliequivalents or greater.

3. An additive composition according to claim 2, wherein the $C_1$ to $C_7$ alkyl group on the alkylphenol is a substantially straight-chain alkyl group.

4. An additive composition according to claim 1, wherein said olefin or alcohol has at least 8 carbon atoms.

5. An additive composition according to claim 4, wherein said olefin or alcohol has at least 18 carbon atoms.

6. An additive composition according to claim 4, wherein said overbased alkylphenoxy sulfonates have a viscosity which is no greater than about 250 cSt at a temperature of about 100 ° C. in the presence of 40 weight percent diluent oil.

7. An additive composition according to claim 1, wherein said olefin or alcohol is a substantially straight-chain olefin or alcohol.

8. An additive composition according to claim 7, wherein said substantially straight-chain olefin or alcohol is an internal or an alpha olefin or an internal or an alpha alcohol.

9. An additive composition according to claim 1, wherein the alkylphenoxy sulfonate is overbased so as to provide for an alkylphenoxy sulfonate additive composition having a TBN which is no greater than about 50.

10. An additive composition according to claim 1, wherein said alkaline earth metal base is a calcium base.

11. A lubricating oil composition comprising an oil of lubricating viscosity and from about 0.5 to about 40 weight percent of an additive composition according to claim 1.

12. A method for reducing the viscosity of a lubricant additive composition comprising neutral and low overbased alkylphenoxy sulfonates which method comprises:

(a) forming a lubricating oil soluble alkylphenol by contacting an olefin or alcohol with phenol or a $C_1$ to $C_7$ alkylphenol in the presence of an acidic alkylation catalyst having a Hammett ($H_o$) value of about −2.3 or less at a temperature above about 90° C. and under conditions sufficient to cause alkylation of the phenol wherein the olefin or alcohol has a sufficient number of carbon atoms to impart oil solubility to the resulting alkylphenol;

(b) sulfonating the alkylphenol prepared in (a) above so as to produce an alkylphenol sulfonic acid; and (c) neutralizing the product prepared in (b) above with a sufficient amount of an alkaline earth metal base so that the resulting product has a TBN from 0 to about 100.

13. A method according to claim 12, wherein the acidic alkylation catalyst is further characterized as having an acid number of 5.0 milliequivalents or greater.

14. A method according to claim 13, wherein the $C_1$ to $C_7$ alkyl group on the alkylphenol is a substantially straight-chain alkyl group.

15. A method according to claim 12, wherein said olefin or alcohol has at least 8 carbon atoms.

16. A method according to claim 15, wherein said olefin or alcohol has at least 18 carbon atoms.

17. A method according to claim 15, wherein said overbased alkylphenoxy sulfonates have a viscosity which is no greater than 250 cST at a temperature of about 100° C. in the presence of 40 weight percent diluent oil, wherein said diluent oil has a viscosity of from about 2 to about 10 cSt at 100° C.

18. A method according to claim 12, wherein said olefin or alcohol is a substantially straight-chain olefin or alcohol.

19. A method according to claim 18, wherein said substantially straight-chain olefin or alcohol is an internal or an alpha olefin or an internal or an alpha alcohol.

20. A method according to claim 12, wherein the neutral or low overbased alkylphenoxy sulfonates have a viscosity of no more than 1000 cST at 100° C. in the presence of 40 weight percent diluent oil, wherein said diluent oil has a viscosity of from about 2 to about 10 cSt at 100° C.

21. A method according to claim 20, wherein the alkylphenoxy sulfonates are overbased so as to provide for an alkylphenoxy sulfonate additive composition having a TBN which is no greater than about 50.

22. A method according to claim 12, wherein said alkaline earth metal base is a calcium base.

* * * * *